United States Patent [19]

Dickinson et al.

[11] Patent Number: 5,035,285

[45] Date of Patent: Jul. 30, 1991

[54] GRAVEL PACKING SYSTEM FOR A PRODUCTION RADIAL TUBE

[75] Inventors: Ben W. O. Dickinson, San Francisco; Randall R. Anderson, Vallejo; Robert W. Dickinson; Eric W. Dickinson, both of San Rafael; Herman Dykstra, Concord, all of Calif.

[73] Assignee: Petrolphysics Operators, San Francisco, Calif.

[21] Appl. No.: 582,438

[22] Filed: Sep. 13, 1990

Related U.S. Application Data

[62] Division of Ser. No. 373,146, Jun. 28, 1989, Pat. No. 4,974,672.

[51] Int. Cl.[5] ..... E21B 43/00

[52] U.S. Cl. ..... 166/65.1

[58] Field of Search ..... 166/65.1, 305.1, 306–309

[56] References Cited

U.S. PATENT DOCUMENTS

| | | | |
|---|---|---|---|
| 4,484,627 | 11/1984 | Perkins | 166/65.1 X |
| 4,519,455 | 5/1985 | Holtmyer et al. | 166/305.1 |
| 4,886,126 | 12/1989 | Yates, Jr. | 166/65.1 X |
| 4,953,636 | 9/1990 | Mohn | 166/65.1 |

*Primary Examiner*—Thuy M. Bui

*Attorney, Agent, or Firm*—Flehr, Hohbach, Test, Albritton & Herbert

[57] ABSTRACT

A system for gravel packing a production radial tube terminating in an open drillhead in electrically conductive oil bearing formation. An elongate perforating tube having spaced ports with electrically conductive perimeters connected to an electrical power source is passed to the forward end of the radial tube. Then an electrolyte solution is passed through the hollow interior of the perforating tube and out the ports to be directed against the tube while current is supplied to form spaced perforations in the tube. Then the perforating tool is withdrawn.

4 Claims, 6 Drawing Sheets

GRAVEL PACKING SYSTEM FOR A PRODUCTION RADIAL TUBE

This is a division of application Ser. No. 373,146 filed Jun. 28, 1989, now U.S. Pat. No. 4,974,672.

CROSS-REFERENCE TO RELATED APPLICATIONS

Reference is made to Dickinson et al. application entitled Mechanically Actuated Whipstock Assembly, and to Dickinson, et al. application entitled Earth Drilling Method and Apparatus Using Multiple Hydraulic Forces, both applications filed simultaneously herewith.

BACKGROUND OF THE INVENTION

This invention relates to earth well drilling systems. In particular, it relates to apparatus and methods for gravel packing one or more production radial tubes extending into an earth formation from a well bore.

A number of techniques are known for passing a drill string down a well bore through a whipstock into adjacent underground formation. One particularly effective technique is disclosed in Dickinson et al. U.S. Pat. No. 4,527,639 wherein a piston-like system permits the turning of a rigid pipe drill string through a short radius 90° turn. This is accomplished by directing hydraulic fluid against the rearward side of drillhead at the forward end of the drill string to provide a pulling force at the drillhead to move the pipe into the formation without buckling of the pipe. An improvement on this system is described in co-pending Dickinson et al. application entitled Earth Drilling Method and Apparatus Using Multiple Hydraulic Forces, filed simultaneously herewith, wherein pushing forces at the rearward end of the drill string are used in addition to the pulling forces to move the rigid pipe through the whipstock and to control the rate of movement of the pipe.

Erectable whipstocks are known and described in Dickinson et al. U.S. Pat. No. 4,527,639 and in EPA Publication No. 0 100 230. There, a retractable whipstock consisting of connected assemblies are disclosed which extend from a retracted position within the structure to form an arcuate tube bending guideway by applying hydraulic forces from the surface to a hydraulic piston assembly. After placement of the production radial tube, it is severed near the whipstock, and the remaining drill string and whipstock may be withdrawn as by pulling from the surface. The procedure is repeated to place multiple radial tubes into other portions of the formation.

In co-pending Dickinson et al. application entitled Mechanically Actuated Whipstock Assembly, an improved retractable whipstock is disclosed which includes a structure with a number of collapsed, connecting guideway assemblies and a retractable anchor connected to the rear side of the anchor assembly. Erection means is provided which is slidable within the assembly and pivotally connected to a forward one of the guideway assemblies and at its other end to an extension member extending to the surface. When the system reaches the desired position adjacent the formation, the anchor is locked in the earth well and the erection means is pulled by an extension arm from the surface to cause a forward one of the guideway assemblies to be pivotally swung so that the guideway assemblies in composite form a curved pathway extending into the formation. After erection, a drill string is passed through the whipstock into the formation and used as for steam injection. The radial tube is cut near the whipstock exit for production and a portion of the tube and the whipstock is pulled back from the surface. The system also includes a deerection system in which the extension arm is again lowered to cause the guideway assemblies to move back into their retracted position. The anchor means is collapsed and the entire assembly may be moved to another position within the well or pulled to the surface. In this manner, multiple radial tubes may be placed into the formation.

The present invention relates to a system of gravel packing which is particularly effective for gravel packing radials in conjunction with the above type of systems using multiple production radial tubes. Gravel packing is a technique whereby gravel is packed around a production well extending into an underground formation. The well typically is lined with a slotted liner which includes slots of a size sufficient to pass oil from the surrounding formation into the liner for pumping to the surface but small enough to screen out the gravel pack particles.

Various gravel packing techniques are disclosed in Zublin U.S. Pat. No. 2,434,239, Sparking U.S. Pat. No. 28,372 and Medlin U.S. Pat. No. 4,378,845. Zublin discloses gravel packing of lateral pipes which are withdrawn during gravel packing. Medlin discloses gravel packing from a well through a lateral screen. Sparkin discloses gravel packing a well by pumping through casing perforations.

SUMMARY OF THE INVENTION

The present invention is directed primarily to a system for use in the recovery or enhancement of recovery of oil from an oil-bearing formation. Specifically, the system relates to the gravel packing of one or more production radial tubes extending from a well bore into the formation, preferably after placement by passage through a whipstock. The system is useful for gravel packing multiple radial tubes extending into the formation from a single well bore. Such radial tubes are placed by techniques such as of the aforementioned type. As used herein, the terms "production radial tube" or "radial tube" refer to that portion of a drill string extending from the surface into the formation. Such radial tubes are connected to the remainder of the drill string extending through the well bore (termed "the main drill string") during drilling but may be severed from the main drill string prior to production.

In a general method for gravel packing, after an annulus is formed between the radial tube and formation during drilling, slurry flows through the interior of the radial tube and out its open distal end into the annulus and back towards the well bore to form a jacket of gravel pack particles. Preferably, after forming the gravel pack jacket, the radial pipe is severed from the drill string in the well bore and gravel pack is flowed into the annulus from the well bore toward the distal end of the radial tube to enlarge the gravel pack jacket. Prior to severing, a permeable plug filter preferably is placed in the radial pipe distal of and near to the severing point. The plug filters serve to block gravel pack particle flow while passing fluid (oil) into and out of the radial tube.

In a specific embodiment, the radial tube is perforated with multiple ports near its distal end and including other ports along its length using a hollow tube perforating tool which is passed through the radial tube.

Such tool may include spaced ports with electrically conductive perimeters connected to a power source, together with fin-like ridges extending along its exterior wall serving to centralize it in the radial tube. Electrolyte solution is passed through the lumen of the perforating tool and out the ports to be directed against adjacent regions of the electrically conductive radial pipe to cut the openings. Then, the perforating tool is withdrawn. An elongate hollow tube liner preferably is placed within the radial tube, which liner including openings of a size to permit passage of fluid such as oil but not the gravel pack particles. By including ports along the length of the radial tube together with the flexible liner, some of the liquid in the slurry passes from the liner interior and out the radial tube perforations into the formation to assist movement of the slurry toward the well bore. A permeable plug filter is placed within the tube adjacent the multiple perforations to filter out gravel pack particles, while permitting passage of the oil.

Control of the amount of gravel packing can be accomplished by sensing the electrical conductivity in the annulus near the proximal end of the radial tube to determine the presence of the gravel pack. The flow of gravel pack slurry is discontinued in response to such sensing.

DETAILED DESCRIPTION OF THE PREFERRED EMBODIMENTS

Figure 1:
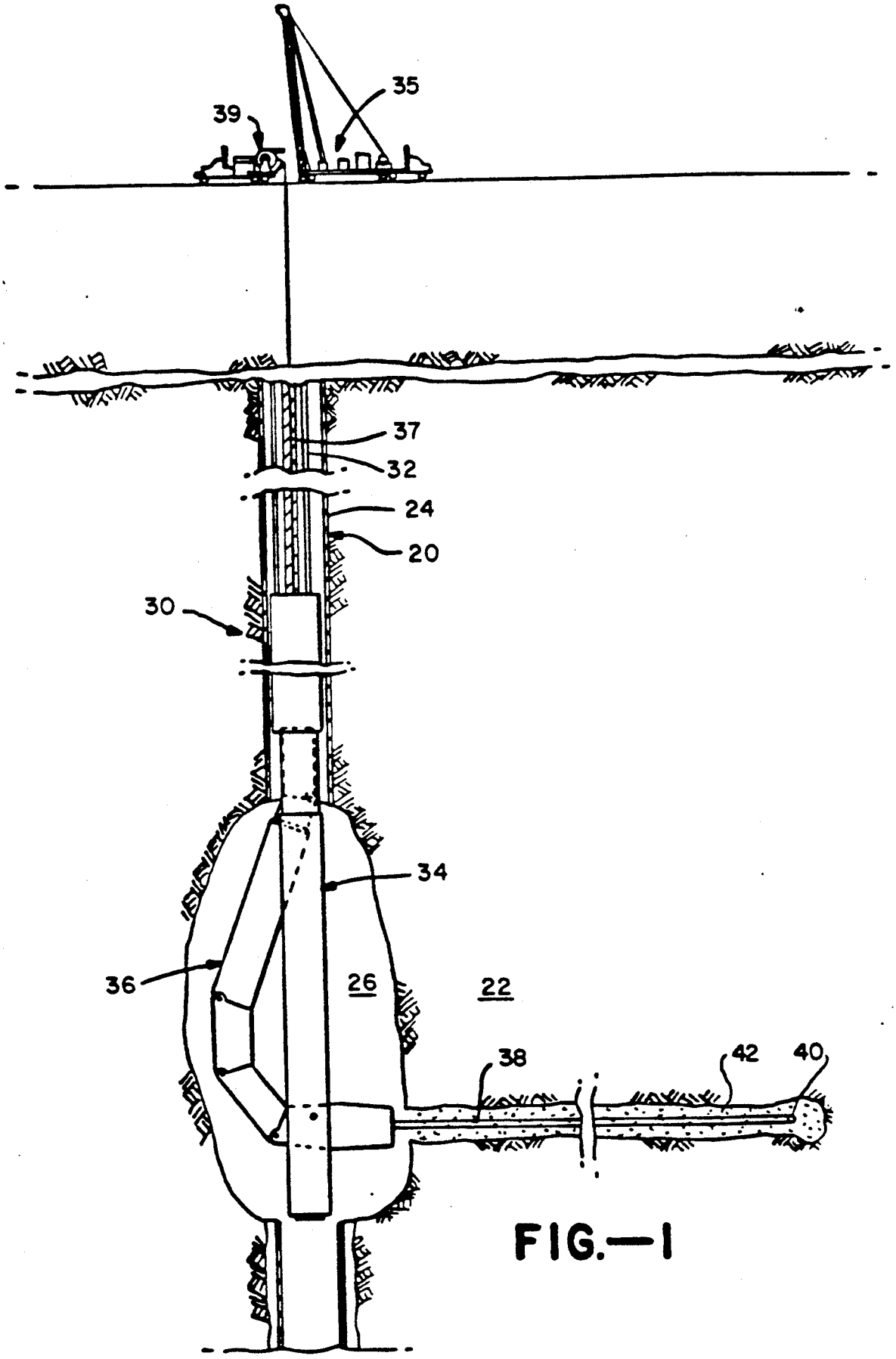
FIG. 1 is a side elevational view in section showing one type of drill system including a radial tube in the formation which can be gravel packed in accordance with the present invention.
Figure 2:
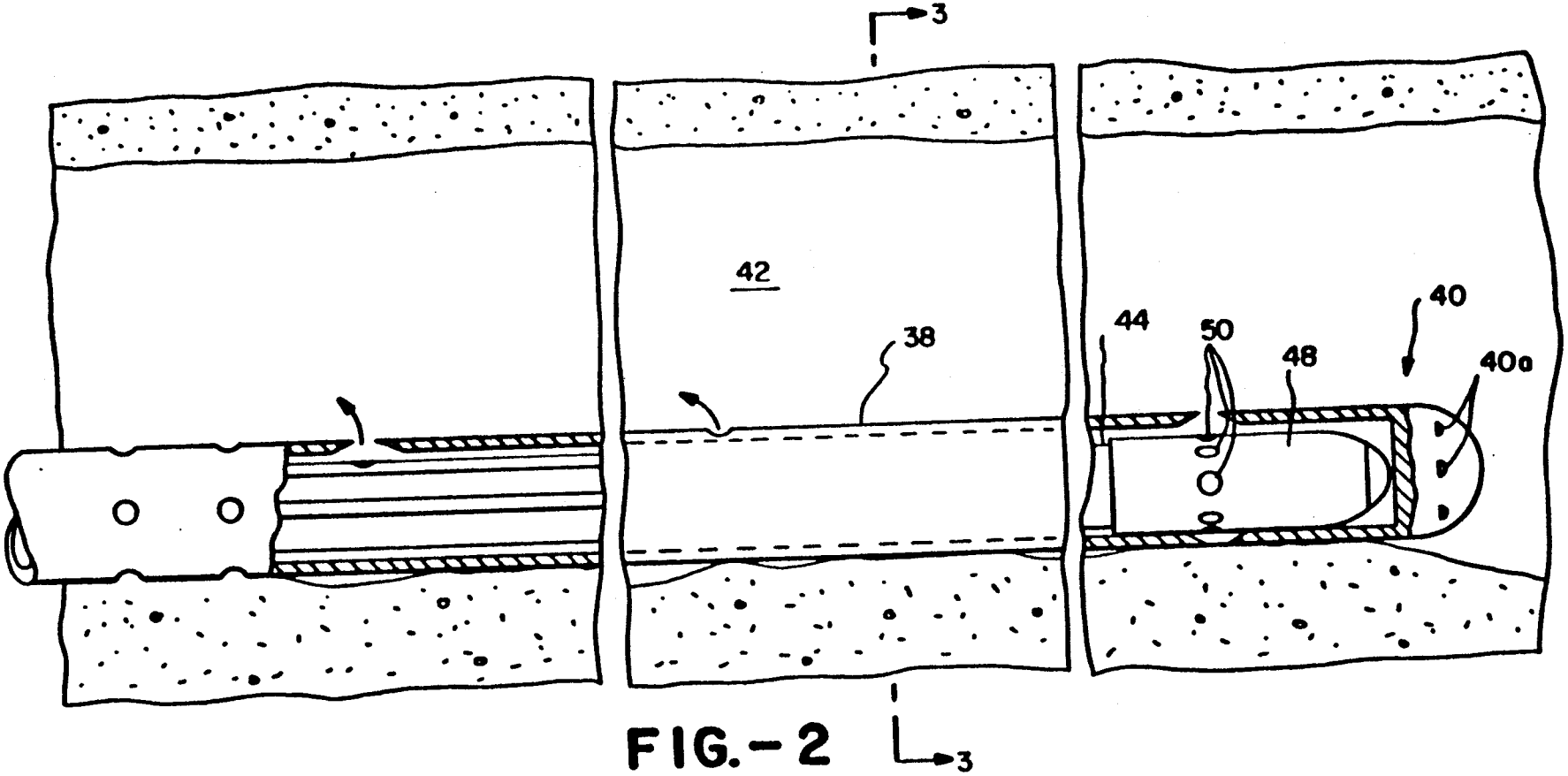
FIG. 2 is a cross-section of a perforated radial tube partially broken away showing a perforating tool.
Figure 3:
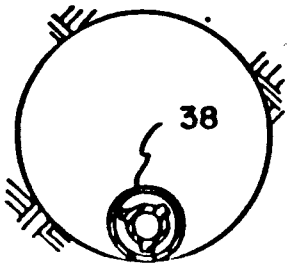
FIG. 3 is a cross-sectional view of FIG. 2 taken along line 3—3.

FIG. 1 schematically shows an earth well 20 which extends down to an oil bearing formation 22. In this instance, well is shown provided with a casing 24 which may extend down to an underreamed cavity 26 that is adjacent to the formation 22. Structure 30 includes piping 32 extending in the well consisting, in this instance, of a pipe string within which a drilling string is normally disposed. Structure 30 also includes housing 34 serving to carry whipstock means 36. Main drill string 37 passes through piping 32, whipstock means 36, and projects into the formation as radial tube 38 terminating in drillhead 40 including ports for passing drilling fluid into the formation. Main drill string 37 and radial tube 38 are, in composite, the drill string formed of a hollow rigid metal solid wall. FIG. 1 also schematically shows a production rig 35 of the mobile type and a reel carrying truck 30 which may carry a supply of drill string for use in the well that is not connected to the drill string during its placement.

The system of FIG. 1 illustrates a retractable whipstock capable of placing multiple radial pipes in a single well. Specifically, whipstock 36 passes through the well in a retracted position until it reaches the position in the well at which radial tube 38 is to be extended into the formation. Then, the whipstock is extended into its operable position, as illustrated in FIG. 1 and the tube is placed. The whipstock is suitably of the type illustrated in the aforementioned Dickinson et al. application entitled Mechanically Actuated Whipstock Assembly. Alternatively, another type of whipstock, such as illustrated in U.S. Pat. No. 4,497,381, may be employed. A particularly effective system in which the drill string forms a piston sliding in a guide tube. Pressurized fluid flowing through the piston body applies pressure against the drillhead causing it to move into the formation at the same time as it is cutting a pathway for itself. A system of this type is described in U.S. Pat. No. 4,527,639. A modification of this system is described in the aforementioned Dickinson et al. application entitled Earth Drilling Method and Apparatus Using Multiple Hydraulic Forces.

In the above system, during drilling, radial tube 38 passes through whipstock 36. Drilling fluid passes through the ports of drillhead 40 creating an annulus 42 between radial tube 38 and the surrounding formation. A feature of the invention is to provide an effectie means of gravel packing of annulus 42.

Gravel packing constitutes the placement of particles in an oil permable porous mass or jacket (termed "gravel pack") in a zone, such as annulus 42. The gravel pack passes oil while filtering out most of the particles in the surrounding formation. Such gravel, typically in a sieve size range of 6 to 40, is placed by passage to the desired area in a slurry form and compacted in that area. For example, it is well known to pack underreamed area 26 with gravel pack particles.

In general, gravel packing is accomplished by flowing the slurry of particles, of appropriate size to form gravel pack, from within the well bore through the lumen of radial tube 38 and out openings in the distal end of the tube into annulus 42 and back towards the well bore to form a jacket of gravel pack in the annulus. After termination of gravel pack flow, water may be flowed through the radial tube at a pressure and for a time sufficient to remove the particles from the radial tube lumen.

In one aspect of the invention, illustrated in FIGS. 2-6, the radial tube is perforated after placement in the formation. The radial tube is perforated with multiple openings disposed towards the distal end through which the gravel pack slurry is flowed. Preferably, additional perforations are also formed at spaced intervals along the remaining length of radial tube 38.

Figure 6:
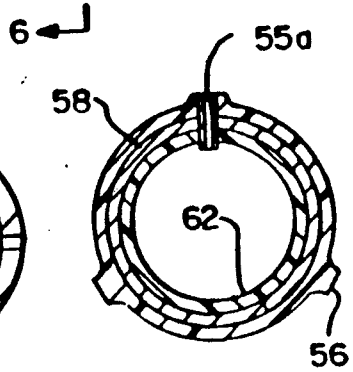
FIG. 6 is a cross-sectional view of the perforating tool taken along the lines 6—6 of FIG. 4.
Figure 5:
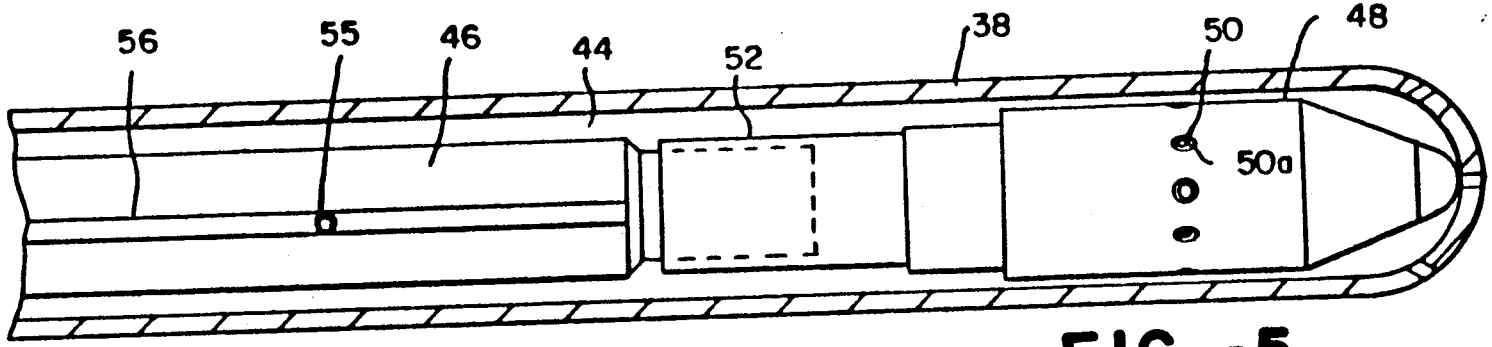

Perforation may be accomplished electrolytically by use of a perforating tool 44 which is functional in combination with an electrically conductive radial tube 38. The tool includes an elongate hollow perforating tube portion 46 terminating at its forward end in a nose portion 48 including circumferentially spaced electrically conductive nose port walls 50 defining about 8 to 16 outer diameter ports 50*a* extending through hollow nose portion 48. Nose portion 48 is formed of an electrically insulative material which insulates port walls 50 from each other. In turn, such port walls are electrically connected to a source of power, suitably through an electrically conductive connector 52 which in turn is electrically connected to a conductor embedded in tube portion 46 which then connects to the power source. This same electrical conductor connects conductive tube port walls 55 defining ports 55*a* formed on three fin-like ridges 56 spaced approximately equidistantly, as best illustrated in FIG. 6. Ridges 56 serve to center tube portion within the radial tube so that the tube ports 55*a* are approximately equidistant from the radial tube 38 to provide gravel pack ports of approximately uniform size. Tube port walls 55 are electrically conductive cylinders projecting through the tube portion walls and electrically connected through flexible metal sheath 58 which extends from connector 52 to the source of power. Metal sheath 58 is insulated by outer electrically insulated jacket 60 and inner electrically insulated jacket 62. Tube portion 46 is sufficiently flexible to pass through the turn of whipstock means 36.

Figure 4:
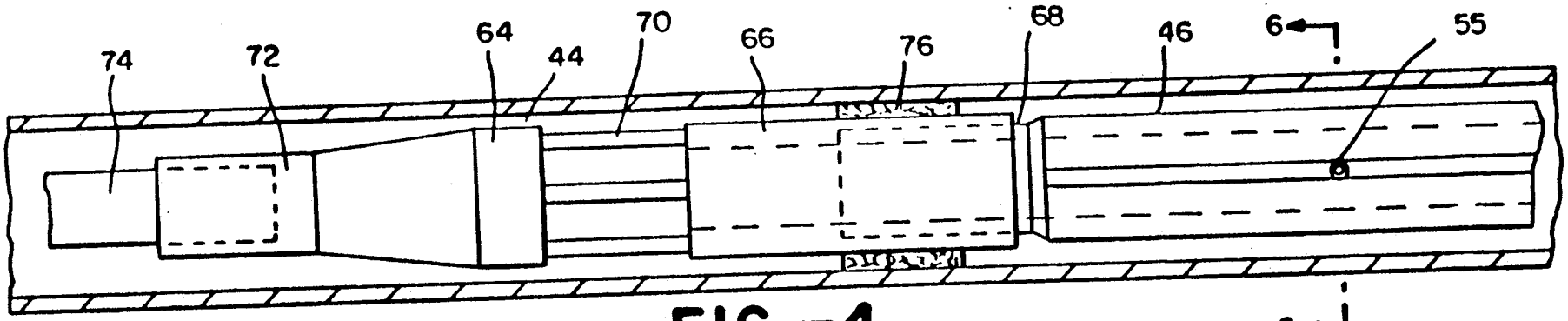
FIGS. 4 and 5 are cross-sectional views of the rearward and forward portions, respectively, of a perforating tool disposed in a radial pipe.

In operation, an appropriate electrolyte, such as an aqueous solution of potassium chloride, is passed from the surface through the interior of the tube portion 46 and the hollow nose portion 48, and ports 50*a* to contact the portions of the electrically conductive radial tube 38 adjacent such ports. By passing the electrolyte through the ports and simultaneously applying the electrical current, perforations are formed in the region adjacent to ports 50*a* of a size sufficient to pass gravel pack particles. To accomplish this objective, it is preferable to flow the electrolyte only from within with hollow perforating tool 46 and out the ports. A suitable rear connector assembly 64 for accomplishing this objective is illustrated in FIG. 4. Assembly 64 includes a hollow metal tube 66 electrically connected by adaptor 68 to metal sheath 58. At the other end of tube 66 is means providing entry of the electrolyte into the tube and for passing of current to it. In this instance, such means comprises electrically conductive spaced bars 70. Another electrically conductive adaptor 72 interconnects the rearward side of bars 70 and electrical cable 74 which extends to the source of electrical power. A flexible seal 76 is provided around tube 66 to block the passage of electrolyte in the annulus between tube 66 and radial tube 38 so that the fluid is directed through bars 70 to the inside of tool 46. In this manner, electrolyte passes through ports 50*a* and 55*a* in a concentrated stream to provide a precise area of electrolyte contact during formation of the perforations.

When perforations are formed only at the distal end of radial tube 38 through ports 50*a*, the elongate hollow perforating tool 44 is passed through radial tube 38 until its forward end is adjacent that end. Then, the electrolyte solution is passed through the lumen of the perforating tool and out ports 50*a* to be directed against adjacent regions of the electrically conductive radial tube while current is supplied to the port walls 50 to form spaced perforations at the adjacent regions of the radial tube. Thereafter, the perforating tool is withdrawn.

If desired, perforations are also formed at spaced intervals along the length of the radial tube by including the aforementioned port walls 55 and passing the electrolyte through the ports 55*a* to perforate the radial tube 38 in a similar manner to the perforations formed at the distal end.

Figure 7:
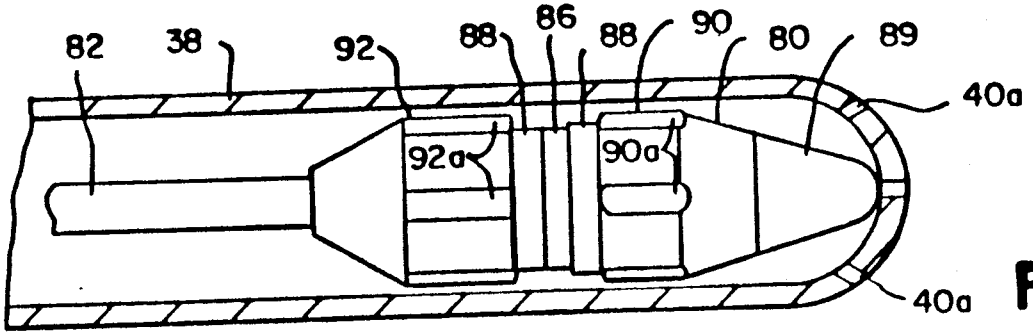
FIG. 7 is a side elevational view of a forward portion of a pipe cutting device disposed in a radial tube.

Referring to FIG. 7, an electrolytic pipe cutting device 80 is illustrated connected to an electric cable 82 which, in turn, is connected to the source of electrical power, not shown. Device 82 includes a nose cone 84 suitably formed of an impact resistant material such as nylon and an electrically conductive metal strip 86 electrically connected to cable 82. Cutting device 80 also includes ceramic rings 88 on both sides of metal strip 86 serving as heat sinks to remove heat generated at strip 86 during cutting. Cutting device 80 also includes forward and rearward liquid channeling sections 90 and 92, respectively, with channels 90*a* and 92*a* respectively, serving to channel the flow of liquid passing ring 86.

In operation, the cutting device of FIG. 6 is pushed to a predetermined area of radial pipe 38 and an aqueous electrolytic solution, such as of potassium chloride, is pumped passed the cutting device 80 and out drillhead ports 50*a*. In the illustrated embodiment, the cutting device 80 is directed to the drillhead until nose portion 84 abuts the rearward side of the drillhead to position strip 86. Then, the electrolyte is directed passed strip 86 while a DC power source energizes the strip. An electrical circuit is completed between strip 86 and the adjacent wall of radial tube 38 and the radial tube is severed. As will be explained more fully hereinafter, after severing, pipe cutting device 80 is pulled out of radial tube 38. A suitable permeable filter device is placed proximal to the opening formed at the severed distal end of radial tube 38 of a type which blocks flow of formation particles into radial tube 38 while permitting the flow of oil. This may be accomplished simultaneously by use of a pipe cutting filter device assembly as shown in FIG. 8.

In order to deerect whipstock means 36 for placing other radial pipes into the formation, radial tube 38 is severed at its proximal end. Then, the main drill string 37 is pulled out of the well and the whipstock is repositioned at a desired location. For example, the whipstock may be left at the same elevation and rotated to a different radial position. Thereafter, another drill string is passed through the whipstock in the manner described above to form spokes projecting from the well axis.

In order to sever the distal end of radial tube 38, a cutting device 80 is positioned near the distal end of radial tube 38. The pipe is severed by passing current through the device while simultaneously flowing an electrolytic solution by it as described above. One way to precisely position the cutting device is to include a rigid bar as a portion of the flexible cable of a length such that it cannot make the full turn through the whipstock. The cutting device is positioned at a predetermined distance downstream from the rigid pipe so that it is near the distal end of radial tube 38. After cutting, cutting device 80 may be pulled to the surface through cable 82. Alternatively, it may be left in place by providing an automatic detachment such as an electric fuse device at the cable connection so that the cutter remains in place while the cable is pulled to the surface. This embodiment is more fully described with respect to FIG. 8.

Figure 8:
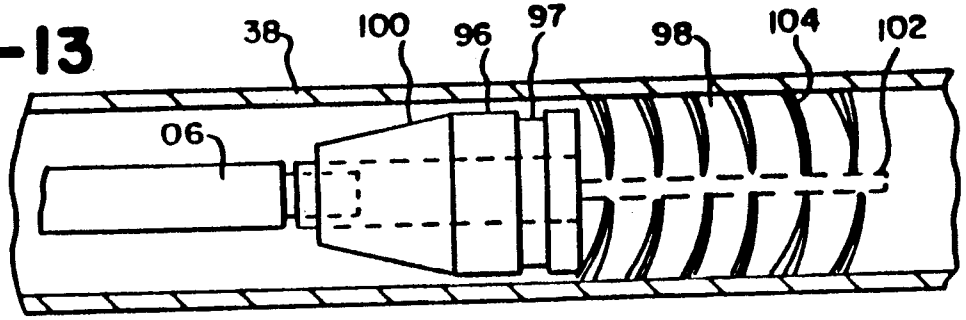
FIG. 8 is a side view of a combination porous plug filter and pipe cutter as disposed in a radial tube.
Figure 14:
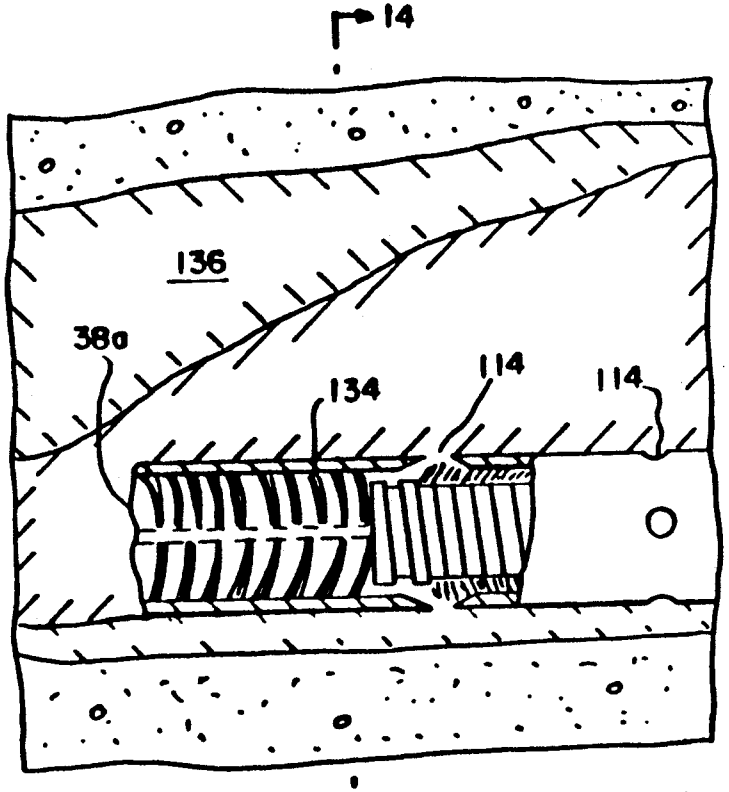
FIG. 14 is a cross-sectional view of FIG. 13 taken along the line 14—14.
Figure 14:
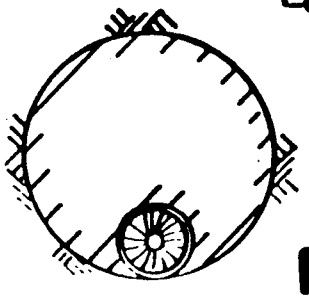

FIG. 8 illustrates an assembly 96 of permeable plug filter portion 98 and pipe cutting portion 100 disposed in radial tube 38. Plug filter portion 98 is constructed to be capable of substantially blocking gravel pack particle flow while passing fluids such as oil. As illustrated, it comprises a bottle brush-like permeable plug including a spine 102 and wire brushes 104 projecting radially from its axis 102 which is mounted to the adjacent portion of pipe cutting portion 100. Further filtration means such as steel wool may be placed between turns of the wire brushes 104 to enhance filtering. Pipe cutting portion 100, including metal strip 97, may be constructed in the same manner as pipe cutting device 86 and interconnected to a suitable source of power through cable 106. Suitable detachment means, not shown, may be provided between cutting device portion 100 and plug filter means 98 for detachment after severing of pipe 38 adjacent metal strip 97. Such detachment means may comprise an electric fuse or a detachable threaded connection or the like. After severing near the proximal end of radial tube 38, cutting device portion 100 may be withdrawn followed by a removal of main drill string 37 to permit deerection of the whipstock. Plug filter means portion 98 serves to maintain the interior of radial tube 38 essentially free of gravel pack or formation particles to permit the oil to accumulate efficiently in the radial tube. For this purpose, as illustrated in FIG. 14, such plug filter means may be placed at both the distal and proximal ends of the radial tube in combination with a liner as described hereinafter. However, in a simplified version of the invention, plug filter means may be placed at the distal and proximal ends of radial tube 38 without the use of a liner so that the oil flows into the radial tube only through the plug filter means, and thereafter through the gravel pack into the underreamed cavity 26 for pumping to the surface in accordance with conventional technology.

Figure 9:
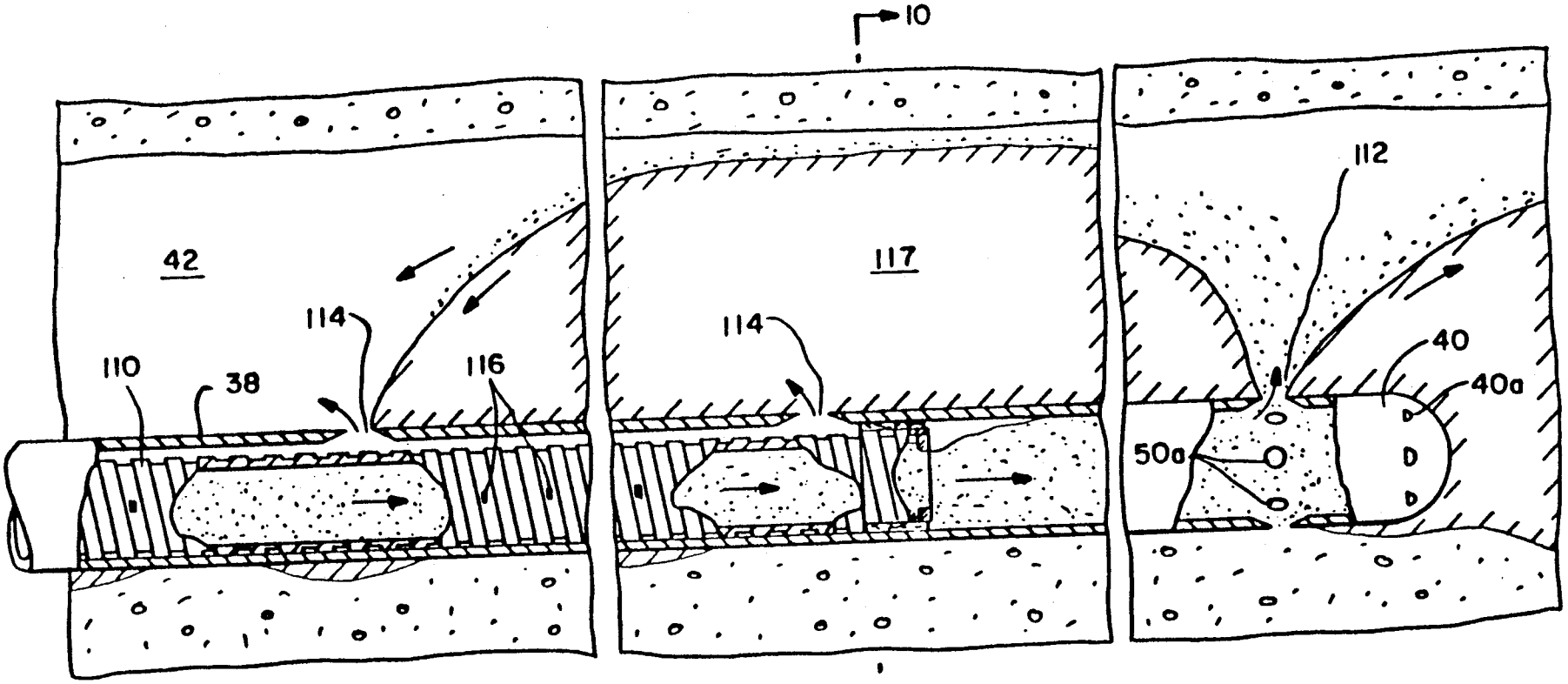
FIG. 9 is a side view of a radial tube partially broken away illustrating a liner for the radial tube, partially as disposed in the formation.
Figure 10:
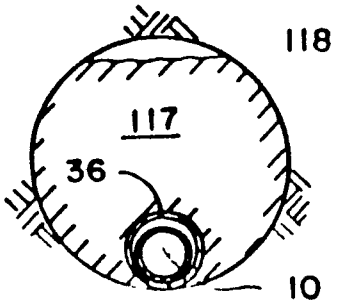
FIG. 10 is a cross-sectional view taken along the line 10—10 of FIG. 9.

Referring to FIGS. 9 and 10, a radial tube 38 is illustrated in the formation with a porous, elongate, hollow tube liner 110 defining lumen 110*a* coaxially disposed within the radial tube. Radial tube 38 includes drillhead 40 with ports 40*a* and circumferentially spaced ports 112 disposed close to the drillhead. Ports 112 serve to permit the flow of gravel pack particles through lumen 110*a* of liner 110 during gravel packing. Radial tube 38 also includes ports 114 spaced longitudinally along the radial tube. Liner 110 is sufficiently flexible so that it may be passed through the curve of whipstock means 36 without undue friction. Liner 110 is also sufficiently permeable to liquid so that a portion of the water content of the slurry passing through lumen 110*a* of liner 110 passes out ports 40*a* into annulus 42. A suitable form of liner 110 to accomplish these objectives is conventional BX electrical conduit for electrical cable, typically formed of an metal spiral wound in a coil with spaces between adjacent coil segments. If desired to increase fluid porosity, additional ports such as slits 116 may be provided in the liner.

As set forth above, prior to placing radial tube 38, the formation adjacent the whipstock is underreamed and the whipstock is erected. Then, slotted liner 110 is placed. In one mode, a flexible piston may be placed on its nose, formed of a material such as Velcro, so that it can be pumped down by passing fluid in the annulus between liner 110 and radial tube 38. Alternatively, liner 110 can be pushed down either by radial tubing and by an internal stiffener rod to provide sufficient rigidity to prevent collapse of the liner during placement. After placement, the internal stiffener rod is removed. In either event, liner 110 is placed until the forward end abuts the rearward side of the drillhead. Then, gravel pack slurry is flowed through the liner and out ports 112 in a distal direction as shown by arrows A and then in a proximal direction in annulus 42 as shown by arrows B. During passage through lumen 110*a*, the gravel is partially dewatered and increases in gravel concentration. A suitable initial concentration of gravel in the slurry is about 1–4 pounds per gallon which may be concentrated about 25–50% during dewatering. Suitably, ports 112 near drillhead 40 are approximately twice the cross-sectional area of radial tube 38. This large area minimizes the pressure drop through the ports and thus the slurry velocity to avoid entrainment of the gravel pack in the formation. Otherwise, such entrainment could deleteriously affect the imprecisely sized intersticies between the gravel grains thereby reducing the life of the gravel pack. The gravel flowing out ports 112 at such lower velocity than during drilling flows towards the well bore and forms a dune 117 because the gravel flow is below the slurrification velocity. The moving sand dune 117 fills up a portion of the annulus 42 and leaves an open area, referred to as an ullage 118, which is segment shaped with a relatively flat bottom and curved top. The face of the sand dune 117 gradually moves to fill up annulus 42 in the range of about 50–90% of the total cross-section of the annulus. As the dune 117 moves back towards the well bore, the water which passed through ports 114 reenters the slurry and tends to preclude sanding off or plugging of the slurry as the sand dune moves toward the well bore. FIG. 9 shows the sand dune 117 in transit prior to reaching the well bore.

Figure 11:
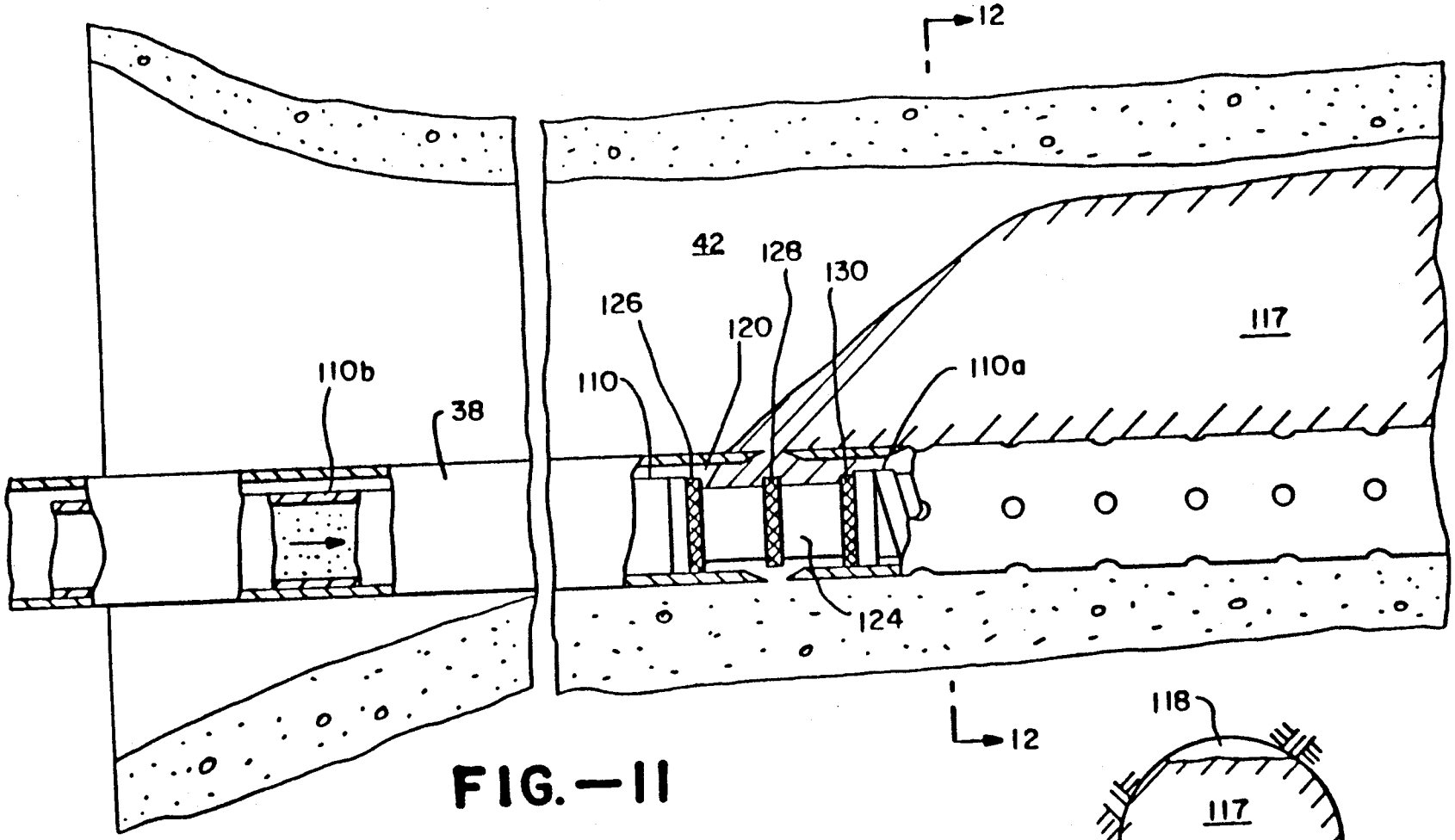
FIG. 11 is a side elevational view partially in section of a perforated radial tube illustrating a liner and a sand dune sensor.
Figure 12:
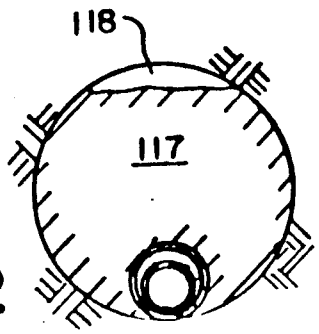
FIG. 12 is a cross-sectional view taken along the line 12—12 of FIG. 11.

Referring to FIG. 11, liner 110 is illustrated again within radial tube 38. Electrical conductivity sensing means 120 is disposed intermediate forward segment 110*a* and rearward segment 110 near the proximal end of radial tube 38. Sensing means 120 serves to detect the presence of gravel pack by a drop in conductivity which occurs when the gravel pack contacts it. As illustrated, sensing means 120 includes an electrically insulating housing 124 which contains axially spaced elctrodes 126, 128 and 130. Electrode 128 is oppositely charged to electrodes 126 and 130, one of which is redundant. The electrical conductivity of the medium disposed between the two oppositely charged electrodes is monitored. Such medium constitutes the liquid or slurry flowing from annulus 42 through ports in radial tube 38 to contact the electrodes. The drop in conductivity caused by the sand dune 127 contacting it is sensed and, in response, gravel flow is discontinued.

Thereafter, plug filter means are placed at both ends of radial tube 38 and the tube distal end is severed from the remaining portion of the drilling string, so that the whipstock may be deerected and additional radial tubes placed into the formation in the same manner. After placement of the desired number of radial tubes, a slotted liner may be placed down the well bore and gravel pack pumped around the liner to fill the underrearmed area 26 and to backfill any remaining void areas in the annulus which have not previously been filled by the sand dune gravel pack jacket.

Referring to FIG. 14, a preferred embodiment of the system is illustrated after completion of gravel packing. Specifically, the radial tube 38 is of the same type as illustrated in FIG. 9 with like parts denoting like numbers and with a severed proximal end 38*a*. The system includes a liner 110 of the aforementioned type disposed within the radial tube. Permeable plug filter means 132 and 134 are placed at the proximal and distal ends, respectively, of the radial tube in the manner described above. Pipe cutting device 80 may also be used to sever the portion of liner 110 disposed between device 80 pipe and radial tube 38. Additional gravel pack 136 is placed in a conventional manner using a slotted liner in the well by pumping through the well and the underreamed portion and continuing pumping until the remainder of the annulus is filled.

Figure 13:
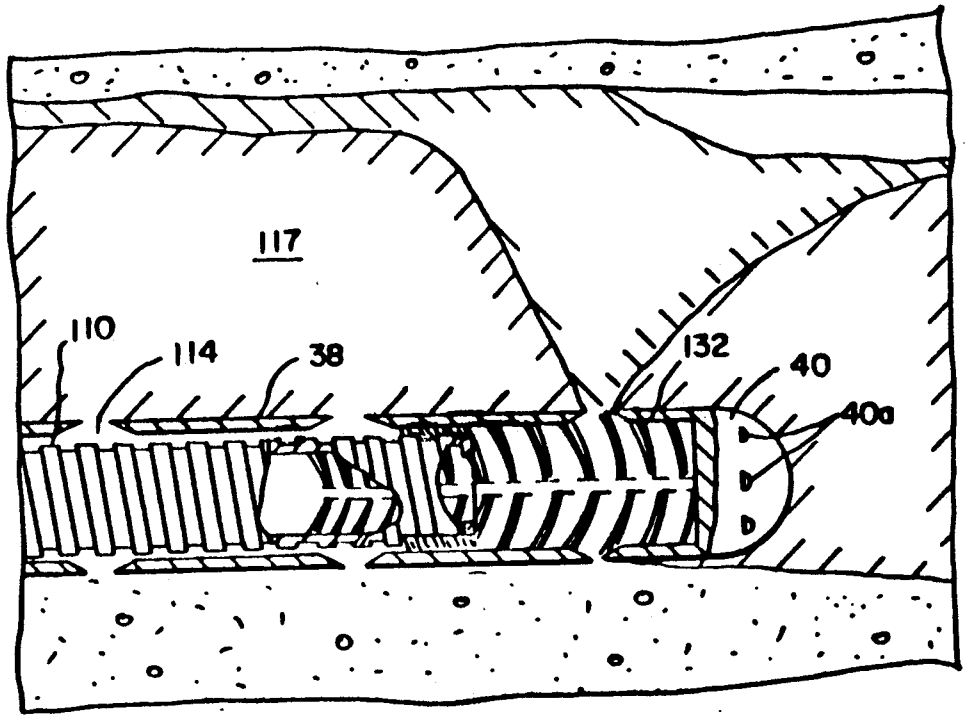
FIG. 13 is a side view partially broken away of a radial tube in the formation, a permeable liner and plug filters at its distal and proximal ends.

The radial tube of FIGS. 13 and 14 is now fully gravel packed and in combination with the conventional well bore is suitable for production. Oil from the surrounding formation flows through radial tube perforations 114 and permeable liner 110 into lumen 110*a* of the radial tube and from there into a sump at the well bore for pumping to the surface in accordance with conventional technology. In the preferred embodiment, multiple radials are placed and disposed in the manner of spokes projecting from an axis.

What is claimed is:

1. A method of forming spaced perforations in an electrically conductive production radial tube extending from a well bore in an underground formation, said method comprising (a) passing an elongate hollow perforating tool, having a forward end and a rearward end and defining a lumen, through the electrically conductive production radial tube having a distal end and a proximal end to be perforated until the forward end of said perforating tool is adjacent the distal end of said radial tube, said perforating tool comprising an elongate hollow perforating pipe with port means defining spaced ports with electrically conductive perimeters connected to an electrical power source through said radial tube, (b) passing an electrolyte solution through the lumen of said perforating tool and out said ports to be directed against adjacent regions of said electrically conductive radial tube while current is supplied to said port perimeters to form spaced perforations at said adjacent regions, and (c) withdrawing said perforating tool.

2. The method of claim 1 in which said radial tube projects generally horizontal into said formation from a generally vertical well bore through a whipstock, and said perforating tool is flexible and turns through said whipstock.

3. The method of claim 1 in which said spaced ports are circumferentially spaced near the distal end of said perforating tool.

4. The method of claim 1 in which said spaced ports are axially spaced along said perforating tool.

* * * * *